US008356631B2

(12) United States Patent
Suzuki et al.

(10) Patent No.: US 8,356,631 B2
(45) Date of Patent: Jan. 22, 2013

(54) FLUID TRANSPORT DEVICE AND FLUID TRANSPORT CONTROL METHOD

(75) Inventors: Hiroaki Suzuki, Ibaraki-ken (JP); Wataru Satoh, Ibaraki-ken (JP); Jun Nakamura, Ibaraki-ken (JP)

(73) Assignees: Riso Kagaku Corporation (JP); University of Tsukuba (JP)

( * ) Notice: Subject to any disclaimer, the term of this patent is extended or adjusted under 35 U.S.C. 154(b) by 504 days.

(21) Appl. No.: 12/677,199

(22) PCT Filed: Sep. 9, 2008

(86) PCT No.: PCT/JP2008/002482

§ 371 (c)(1),
(2), (4) Date: Mar. 9, 2010

(87) PCT Pub. No.: WO2009/034706

PCT Pub. Date: Mar. 19, 2009

(65) Prior Publication Data

US 2010/0200073 A1 Aug. 12, 2010

(30) Foreign Application Priority Data

Sep. 10, 2007 (JP) ..... 2007-234230

(51) Int. Cl.
*F15C 1/04* (2006.01)

(52) U.S. Cl. ..... 137/827; 347/65; 347/85

(58) Field of Classification Search ..... 137/825, 137/827; 347/44, 45, 47, 54, 65, 71, 72, 347/84, 85, 86
See application file for complete search history.

(56) References Cited

U.S. PATENT DOCUMENTS

| | | | | |
|---|---|---|---|---|
| 6,116,257 | A * | 9/2000 | Yokota et al. | 137/1 |
| 6,508,273 | B1 * | 1/2003 | Van Den Berg | 137/827 |
| 8,088,267 | B2 * | 1/2012 | James et al. | 204/547 |

FOREIGN PATENT DOCUMENTS

| | | | |
|---|---|---|---|
| EP | 1439064 | B1 | 7/2004 |
| JP | 2004-216899 | A | 8/2004 |
| JP | 2005-199231 | A | 7/2005 |
| JP | 2006-220606 | A | 8/2006 |

OTHER PUBLICATIONS

International Search Report; PCT/JP2008/002482; Nov. 25, 2008.

* cited by examiner

*Primary Examiner* — Craig Schneider
(74) *Attorney, Agent, or Firm* — Studebaker & Brackett PC; Donald R. Studebaker

(57) ABSTRACT

A fluid transport device transports fluid containing electrolytes within a flow channel. At least a portion of the inner walls of the flow channels are hydrophilic from the inlet to the outlet thereof except at at least one valve portion. The device also includes: the valve portions, which are hydrophobic and function to block transport of at least one fluid; electrodes, which are provided at the at least one valve portion and function to reduce the surface tension of the fluid; and air vents, which are provided at the at least one valve portion and function to introduce air in order to block the fluid.

11 Claims, 10 Drawing Sheets

9-1

9-2

FLUID TRANSPORT DEVICE AND FLUID TRANSPORT CONTROL METHOD

TECHNICAL FIELD

The present invention is related to a fluid transport device. More particularly, the present invention is related to a fluid transport device and a fluid transport control method that employs the device, which are capable of measuring off and transporting a predetermined amount of fluid.

BACKGROUND ART

Recently, researches regarding the chemical analysis systems, called μ-TAS (micro TAS) or "Lab on a Chip" have been being performed in the fields of chemistry, optics, biotechnology, clinical engineering and the like. In these chemical analysis systems, flow channels are formed on a substrate by fine grooves or holes of a chip (microchip), and series of processing steps, such as mixing, chemical reactions, separation, and detection are all performed on the chip. There are various expectations in these miniaturized chemical analysis systems, such as: reduction in the amounts of samples and waste liquids; reduction of analysis time; improved efficiency; reduced amounts of required space; and portability.

It is necessary to transport fluid into fine flow channels within the miniaturized chemical analysis systems. Fluid transport devices that utilize external forces provided by pumps and the like are commonly employed. In these devices, the influence of the interface tension and the like becomes greater as the flow channels become finer, resulting in increased resistance of the fluid that flow within the flow channels. Therefore, high pressure becomes necessary to cause the fluid to flow. However, there is a possibility that the high pressure result in damage to the fine flow channels, and accordingly it has been necessary to form the flow channels to have a strong structure. In addition, there is a problem that greater power consumption is inevitable in order to generate the high pressure.

For these reasons, a fluid transport device that employs a phenomenon called electrowetting (hereinafter, referred to as "EW") has been proposed (Patent Document 1). As illustrated in the left half of FIG. 12, when an aqueous electrolyte solution F is in contact with an electrode E, suppose that voltage is applied between the liquid and the electrode. Then, as illustrated in the right half of FIG. 12, by EW, negative ions gather in the proximity of the solid-liquid interface of the liquid in the case that the electrode is an anode, or positive ions gather in the proximity of the solid-liquid interface of the liquid in the case that the electrode is a cathode. The ions repel each other, to reduce the interface tension of the liquid. That is, a contact angle θ between the liquid and the electrode in the left half of FIG. 12 becomes a smaller contact angle θ' as illustrated in the right half of FIG. 12, due to the reduced interface tension of the liquid. Thereby, the so called wettability of the liquid on the electrode increases.

When the application of voltage is stopped during a state in which the interface tension of the liquid surface is reduced as illustrated in the right half of FIG. 12, the ions which are gathered in the proximity of the interface disperse, the surface tension recovers, and the wettability decreases, as illustrated in the left half of FIG. 12.

Note that the EW phenomenon described above also occurs in cases that an electrode and an aqueous electrolyte solution are not in direct contact, but are insulated by a dielectric film, as illustrated in FIG. 13. This is because the dielectric film becomes polarized such that the side thereof toward the electrode becomes a cathode and the side thereof toward the solution becomes an anode in the case that the electrode is an anode when voltage is applied, or such that the side thereof toward the electrode becomes an anode and the side thereof toward the solution becomes a cathode in the case that the electrode is a cathode when voltage is applied, as illustrated in FIG. 13. Accordingly, the same EW phenomenon as that occurs at the interface between the electrode and the aqueous electrolyte solution occurs at the interface between the dielectric film and the aqueous electrolyte solution.

The fluid transport device leads fluid into a flow channel having hydrophobic inner surfaces, in which electrodes are embedded, by applying voltages to the electrodes and causing the aforementioned EW phenomenon to occur.

Meanwhile, an inkjet printhead that utilizes the EW phenomenon is disclosed (Patent Document 2). In this inkjet printhead, the inner surface of a nozzle near its outlet is covered by a hydrophobic coating. An electric field that progresses toward the outlet along the nozzle is formed to change the surface tension of ink therein, resulting in detaching a drop of ink having a predetermined volume from a continuum of ink supplied. The detached drop of ink is discharged and accelerated electrostatically and therefore ejected from the nozzle.

Patent Document 1:

Japanese Unexamined Patent Publication No. 2005-199231

Patent Document 2:

Japanese Unexamined Patent Publication No. 2004-216899

In the fluid transport device described in Patent Document 1, it is possible to cease movement of the fluid within the flow channel by ceasing the application of voltage. However, the flow channel is filled with the fluid from a reservoir connected to the channel inlet. For this reason, in the case that the aforementioned fluid transport device is utilized in an inkjet printhead or the like, and a material having permeability or hydrophilic properties, such as printing paper, is placed in contact with the channel outlet, the fluid, that is, ink, will be transferred to the material until the material cannot absorb any more ink, or until the reservoir becomes empty. This state is equivalent to that of a fountain pen.

In order for the transfer of the ink onto the material to be ceased in such a case, the channel outlet can be separated from the material, in the same manner that a fountain pen is separated from a sheet. However, if this operation is performed during drawing of intricate patterns, the quality of the patterns may deteriorate, due to slight drag of the contact along the movement direction of the printing paper.

Meanwhile, the printhead disclosed in Patent Document 2 detaches a drop of ink merely by changing the surface tension thereof. Therefore, it is difficult to completely detach the drop within the flow channel.

The present invention has been developed in view of the foregoing circumstances. It is an object of the present invention to provide a fluid transport device, which is capable of completely detaching and measuring off a predetermined amount of fluids within a flow channel.

DISCLOSURE OF THE INVENTION

A fluid transport device of the present invention is a fluid transport device for transporting a fluid containing electrolytes within a flow channel, comprising:

the flow channel, at least a portion of the inner walls of which are hydrophilic from the inlet to the outlet thereof except at least one valve portion;

the at least one valve portion, which is hydrophobic and function to block transport of the fluid;

electrodes, which are provided at the at least one valve portion and function to reduce the surface tension of the fluid; and air vents, which are provided at the at least one valve portion and function to introduce air in order to split the fluid.

It is preferable for the fluid transport device of the present invention to be of a configuration, wherein:

the electrodes have positive and negative poles; and one of the positive and negative poles are provided at the hydrophobic valve portion.

In this case, it is preferable for the positive and negative poles to be arranged along the flow direction of the fluid.

The fluid transport device of the present invention may be of a configuration, wherein:

the electrodes and the flow channel are insulated by a dielectric film.

It is preferable for the fluid transport device of the present invention to be of a configuration, wherein:

the outer peripheral portion of the outlet is hydrophobic.

It is preferable for the fluid transport device of the present invention to be of a configuration, wherein:

the inner wall of an outlet section of the flow channel and the outer peripheral portion of the outlet are hydrophobic; and second electrodes, for reducing the surface tension of the fluid, are provided at the inner wall of the outlet section of the flow channel and at the outer peripheral portion of the outlet.

It is preferable for the fluid transport device of the present invention to be of a configuration, wherein:

an outlet portion of the flow channel, at which the outlet is located, protrudes outward from a main body of the device.

In this case, it is preferable for the outlet portion of the flow channel to be formed by an elastic member.

Note that the outlet portion of the flow channel may be formed by the elastic member, for example, only in the proximity of the outlet, or may be completely formed by the elastic member, as long as the flow channel itself does not deform.

The fluid transport device of the present invention may be of a configuration, wherein:

the outlet portion of the flow channel exhibits elasticity in the direction of fluid flow.

In the fluid transport device of the present invention, the fluid may be a liquid having functional particles dispersed therein.

A fluid transport control method of the present invention is a method for controlling fluid transport employing the fluid transport device of the present invention, comprising the steps of:

applying voltages to the electrodes, to change the hydrophobic nature of the valve portion within the flow channel to a hydrophilic nature;

ceasing the application of voltages to change the hydrophilic nature of the valve portion back to a hydrophobic nature; and introducing air into the valve portions via the air vents, to measure off a predetermined amount of the fluid.

According to the present invention, at least a portion of the inner walls of the flow channel is hydrophilic from the inlet to the outlet thereof except at least one valve portion, which is hydrophobic and functions to block transport of the fluid. The electrodes for reducing the surface tension of the fluid and the air vents that function to introduce air in order to split the fluid are provided at least one valve portion. Therefore, the fluid can be transported, by applying voltage to the electrodes to change the hydrophobic nature of the valve portion to a hydrophilic nature. The transport of the fluid can be ceased, by ceasing the application of voltage to the electrodes to change the hydrophilic nature of the valve portion to a hydrophobic nature, and by introducing air into the valve portion. The air which is introduced into the valve portion can split the fluid within the flow channels.

The fluid can be split within the flow channel. Thereby, it becomes possible to measure off the fluid into a desired amount and transport the amount of fluid, by adjusting the volume of the flow channel.

BEST MODE FOR CARRYING OUT THE INVENTION

Figure 1A:
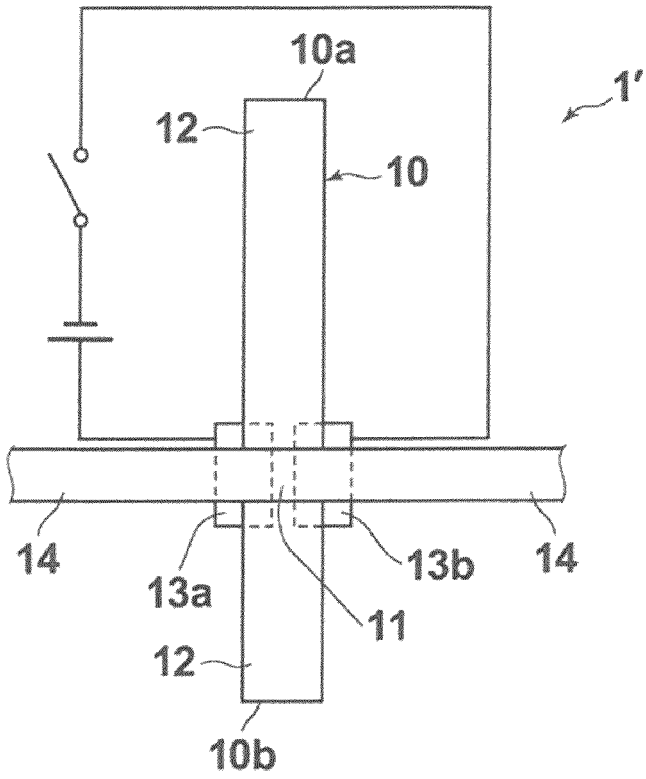
FIG. 1A is a schematic diagram that illustrates the construction of a fluid transport device.
Figure 1B:
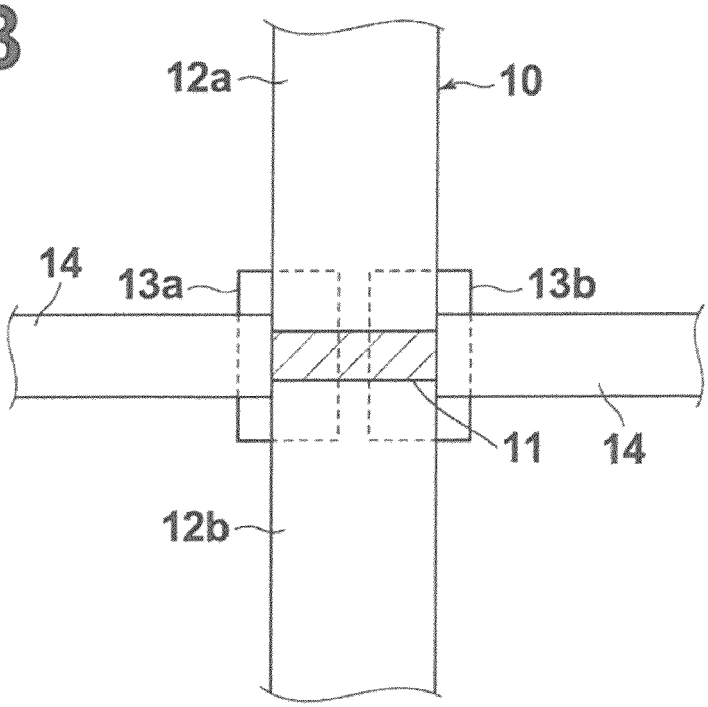
FIG. 1B is an enlarged view of a valve portion of FIG. 1A.
Figure 2A:
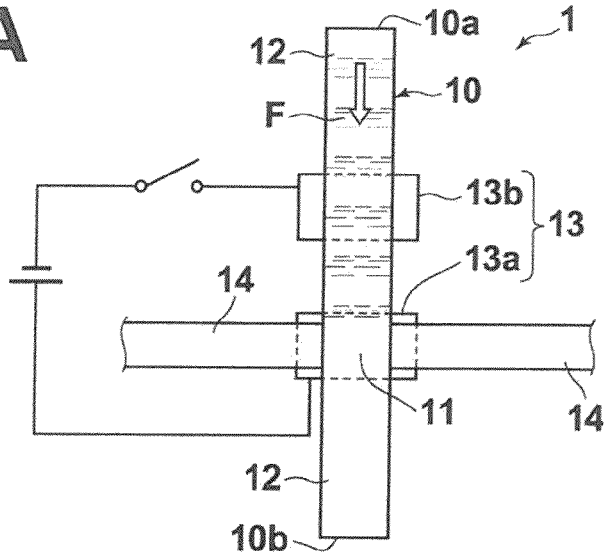
FIG. 2A is a first diagram for explaining the operation of the fluid transport device.
Figure 2B:
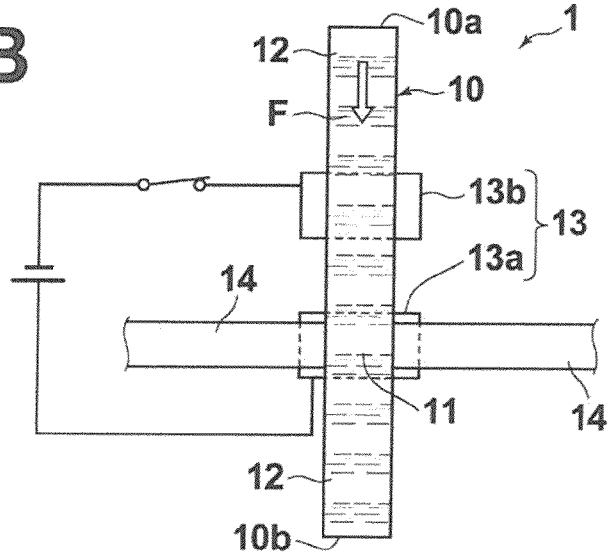
FIG. 2B is a second diagram for explaining the operation of the fluid transport device.
Figure 2C:
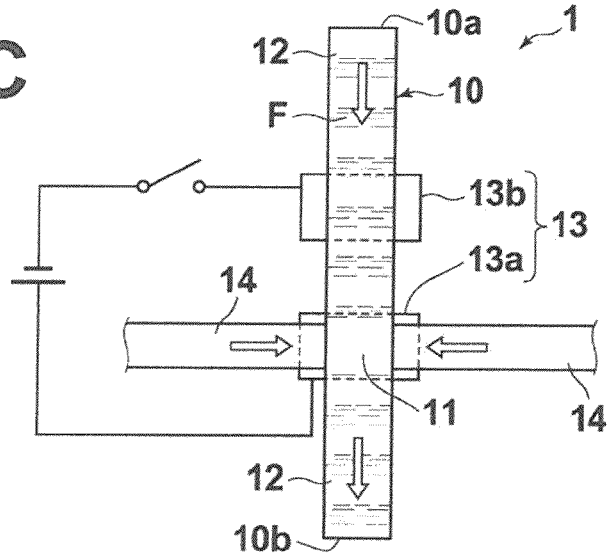
FIG. 2C is a third diagram for explaining the operation of the fluid transport device.

Hereinafter, a fluid transport device 1 according to an embodiment of the present invention will be described with reference to the attached drawings. FIG. 1A is a schematic diagram that illustrates the construction of the fluid transport device 1 of the present embodiment. FIG. 1B is an enlarged view of a valve portion of FIG. 1A. FIGS. 2A, 2B, and 2C are diagrams for explaining the operation of the fluid transport device 1.

As illustrated in FIG. 1A, the fluid transport device 1 of the present embodiment is a device for transporting a fluid F containing electrolytes within a flow channel 10. An inner wall surface 12*a* of the flow channel 10 from an inlet 10*a* to a valve portion 11 to be described later, and an inner wall surface 12*b* of the flow channel 10 from the valve portion 11 to an outlet 10*b* thereof are both hydrophilic. That is, the inner wall surfaces 12*a* and 12*b* of the flow channel 10 are hydrophilic except at the valve portion 11. The flow channel 10 has a fine diameter or a small cross sectional area that enables capillary action to occur. The flow channel 10 may be a groove, or a pipe having a circular or polygonal cross sectional shape. In addition, the entirety of the inner wall surfaces 12*a* and 12*b* may be hydrophilic, or only a single inner wall surface, such as the bottom surface, may be hydrophilic, as long as at least a portion of the inner wall 12 of the flow channel 10 is continuously hydrophilic excluding the valve portion 11.

The valve portion 11 (indicated by hatching in FIG. 1B) is a separating portion between the inner wall surface 12*a* and the inner wall surface 12*b*, and ceases the transport of fluid within the flow channel 10. At least one valve portion 11 is provided within the flow channel 10, and is constituted by a section of the flow channel 10, of which the entirety of the inner wall surface is hydrophobic, as illustrated in FIG. 1B. In addition, the section of the flow channel at the valve portion 11 (hereinafter, referred to as "gap"), that is, the dimension in the direction of fluid flow, is determined by the shape of the flow channel 10.

Electrodes 13, for reducing the surface tension of the fluid F, are provided at the valve portion 11. The electrodes 13 are constituted by a positive pole and a negative pole formed by gold, carbon, or the like. As illustrated in FIG. 1A, the positive pole and the negative pole are arranged along the flow direction of the fluid. In the present embodiment, a positive pole 13*a* is provided at the valve portion 11, and a negative pole 13*b* is provided beneath the inner wall surface 12*a*, toward the side of the inlet 10*a* of the flow channel 10 from the valve portion 11. Here, the phrase "a positive pole 13*a* is provided at the valve portion 11" does not necessarily mean that the positive pole 13*a* covers the entire area of the valve portion 11, and may refer to a case in which the positive pole 13*a* is present across the entire length of the valve portion 11 at least in the direction from the inner wall surface 12*a* to the inner wall surface 12*b*.

That is, as illustrated in FIG. 1B, the valve portion 11 can be formed by administering a hydrophobic coating process on the surface of the positive pole 13*a*, which is provided at the gap between the hydrophilic inner wall surfaces 12*a* and 12*b*. At this time, the hydrophobic coating may be a hydrophobic dielectric film. Note that the hydrophobic coating may be provided on the entire surface of the positive electrode 13*a*. Application of voltage to the electrodes 13 can be initiated or ceased, by turning a switch connected thereto ON and OFF.

Further, air vents 14, for introducing air to cut off the fluid F, are provided at the valve portion 11. As illustrated in FIG. 1A and FIG. 1B, the air vents 14 are formed by grooves or pipes having apertures that communicate with the section of the flow channel 10 where the valve portion 11 is provided. Two air vents 14 are provided at the valve portion 11, in order to positive introduce air thereinto from both sides. In addition, the air vents 14 are formed to have greater diameters than the gap of the valve portion 11. Note that the diameters of the air vents 14 may be less than or equal to the gap, as long as air can be introduced into the valve portion 11. In addition, the diameters of the air apertures are smaller than the diameter of the flow channel 10, and the inner surfaces of the air apertures are hydrophobic, in order to prevent the fluid F from flowing into the air apertures as it flows through the flow channel 10.

The fluid transport device 1 of the present embodiment is constructed as described above. Next, the operation of the fluid transport device 1 will be described.

As illustrated in FIG. 2A, the fluid F is introduced into the flow channel 10 of the fluid transport device 1 from the inlet 10*a*, in a state in which the switch is turned OFF, that is, in a state in which voltage is not being applied to the electrodes 13. The fluid that enters the flow channel 10 through the inlet 10 moves autonomously therethrough by capillary action. Therefore, no external forces, such as pressure, heat, and electric fields, are necessary in order to cause the fluid F to flow through the flow channel 10 of the fluid transport device 1. in addition, because very little current flows through the valve portion 11, the amount of power consumed by the valve portion 11 is extremely small. Accordingly, the fluid transport device 1 is superior in reducing energy consumption.

Further, the fluid transport device 1 is capable of transporting fluid without any particular restrictions, as long as they contain electrolytes. Therefore, various functional fluid can be transported.

Figure 3A:
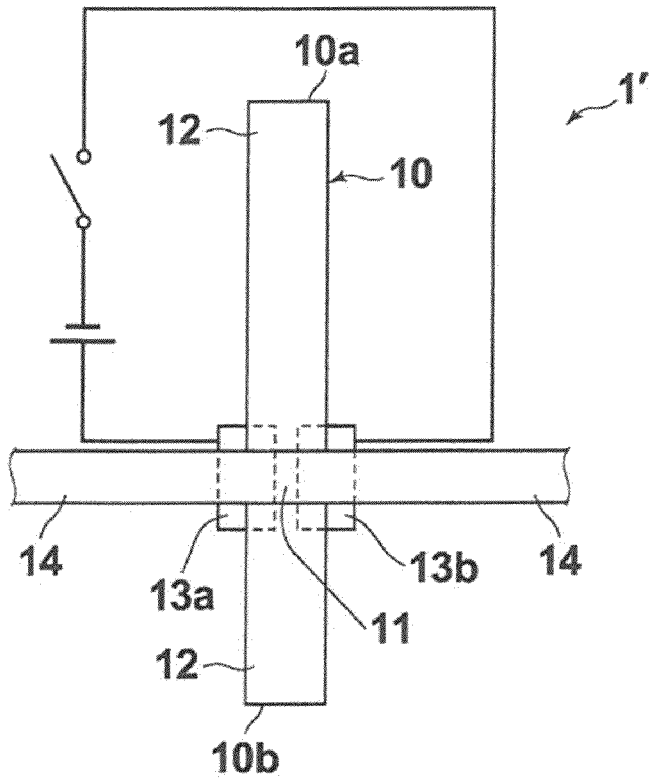
FIG. 3A is a schematic diagram that illustrates the construction of a fluid transport device according to another embodiment.
Figure 3B:
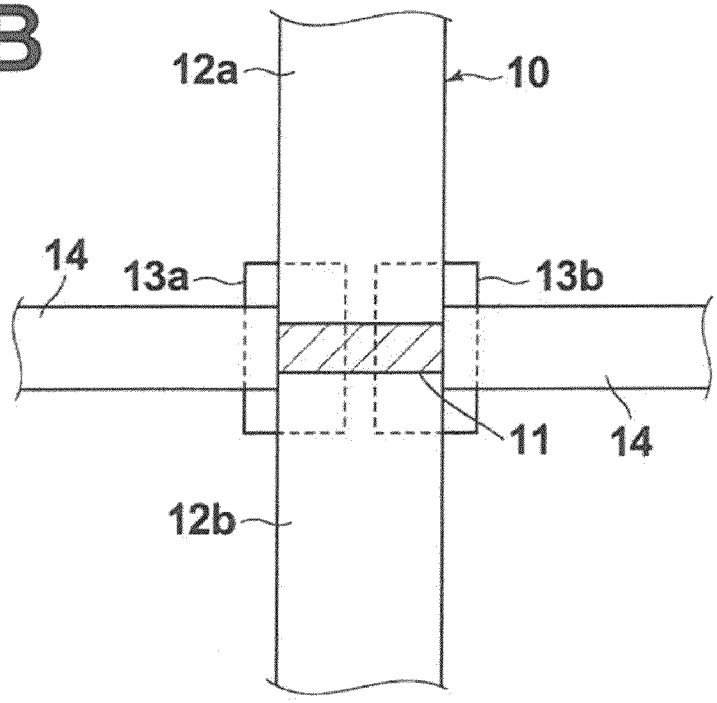
FIG. 3B is an enlarged view of a valve portion of FIG. 3A.

Note that in the fluid transport device 1 of the present embodiment, the electrodes 13 were arranged along the flow direction of the fluid F. However, the present invention is not limited to this configuration. The schematic construction of a fluid transport device 1' according to another embodiment of the present invention is illustrated in FIG. 3A. FIG. 3B is an enlarged view of a valve portion of FIG. 3A. As illustrated in FIG. 3A, in the fluid transport device 1', a positive pole 13*a* and a negative pole 13*b* are provided parallel to each other with respect to the direction that a fluid F flows in. At this time, the positive pole 13*a* and the negative pole 13*b*, which are constituted by hydrophobic dielectric films, are provided such that at least a portion thereof contacts a valve portion 11.

In the fluid transport device 1', when voltage is applied to the electrodes 13, negative ions gather in the proximity of the interface between the part of the valve portion 11 which is in contact with the positive pole 13*a* and the fluid F. Likewise, positive ions gather in the proximity of the interface between the part of the valve portion 11 which is in contact with the negative pole 13*b* and the fluid F. An EW phenomenon occurs at both parts of the valve portion 11, to change the hydrophobic nature thereof to a hydrophilic nature, and the fluid F is enabled to pass therethrough.

Figure 4A:
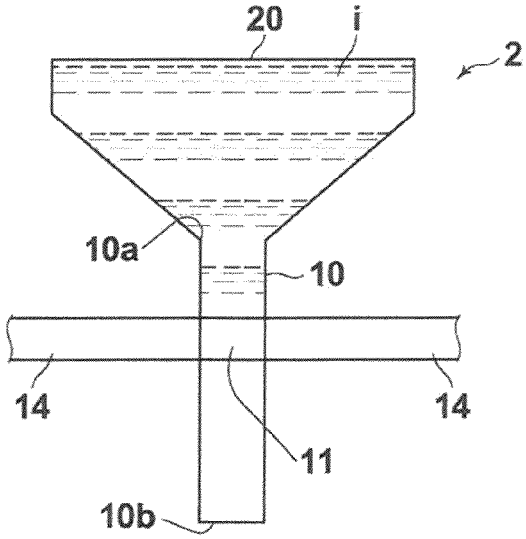
FIG. 4A is a first diagram for explaining the operation of a printhead.
Figure 4B:
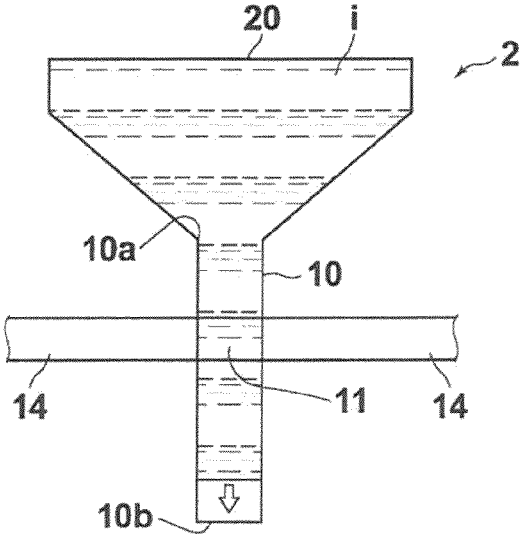
FIG. 4B is a second diagram for explaining the operation of the printhead.
Figure 4C:
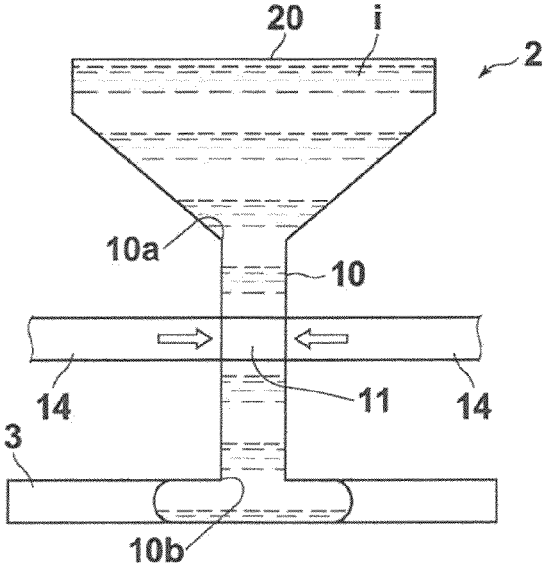
FIG. 4C is a third diagram for explaining the operation of the printhead.

Next, a printhead 2 of an inkjet printer that utilizes the aforementioned fluid transport device 1 will be described. FIG. 4A, FIG. 4B, and FIG. 4C are diagrams for explaining the operation of the printhead 2 according to an embodiment of the present invention. Note that electrodes 13 and switches provided in a valve portion 11 have been omitted from FIG. 4A, FIG. 4B, and FIG. 4C. Elements which are the same as those described with reference to the fluid transport device 1 are denoted by the same reference numerals, and detailed descriptions thereof will be omitted. In addition, a description will be given with the upper sides of FIGS. 4A, 4B, and 4C designated as the upstream sides of fluid flow, and the lower sides of FIGS. 4A, 4B, and 4C designated as the downstream sides of fluid flow, for the sake of convenience.

The printhead 2 of the present embodiment is constituted by the discharge opening of an ink supply tank 20, the diameter of which becomes smaller from the upstream direction toward the downstream direction, connected to the inlet 10*a* of the flow channel 10 of the fluid transport device 1 of the embodiment described above. Note that the ink supply tank 20 is filled with water soluble ink as the fluid F that contains electrolytes.

First, as illustrated in FIG. 4A, the ink i within the ink supply tank 20 is introduced into the flow channel 10 from the ink supply tank 20 via the inlet 10*a*. Then, the ink i moves autonomously and smoothly through the hydrophilic flow channel 10 by capillary action, in the same manner as in the fluid transport device 1, and stops in front of the valve portion 11. Here, if the hydrophobic nature of the valve portion is changed to a hydrophilic nature by applying a voltage to electrodes 13 (not shown), the ink i passes through the hydrophilic valve portion 11 as illustrated in FIG. 4B. Thereafter, the ink i flows into the hydrophilic flow channel toward the side of the outlet 10*b* thereof, by capillary action.

Next, the hydrophilic nature of the valve portion 11 is returned to its hydrophobic nature, by ceasing the application of the voltage. Then, as illustrated in FIG. 4C, the movement of the ink i ceases in front of the valve portion 11. Thereby, the movement of the ink i stops in front of the valve portion 11, air is introduced into the valve portion from the air vents 14, and the air sectionalizes the fluid F. At this time, if a sheet 3 is caused to contact the ink i which has seeped out from the outlet 10*b* of the flow channel, the ink i flows into the sheet 3, and the ink i beyond the valve portion 11 can be transferred to the sheet 3.

The printhead 2 utilizes the EW phenomenon in this manner, and is capable of using a water based ink i, as long as it is a fluid that contains electrolytes. Therefore, the burden on the environment can be suppressed compared to oil based liquids when printed matter, onto which the ink i has been transferred, is discarded after use.

It is possible to cut the ink i within the flow channel 10, in the same manner as in the fluid transport device 1 of the previously described embodiment. Therefore, it becomes possible to divide the ink i into desired amounts and transport the divided amounts of ink i, by adjusting the volume of the flow channel 10. Accordingly, desired amounts of the ink i can be transferred onto the sheet 3.

Figure 5A:
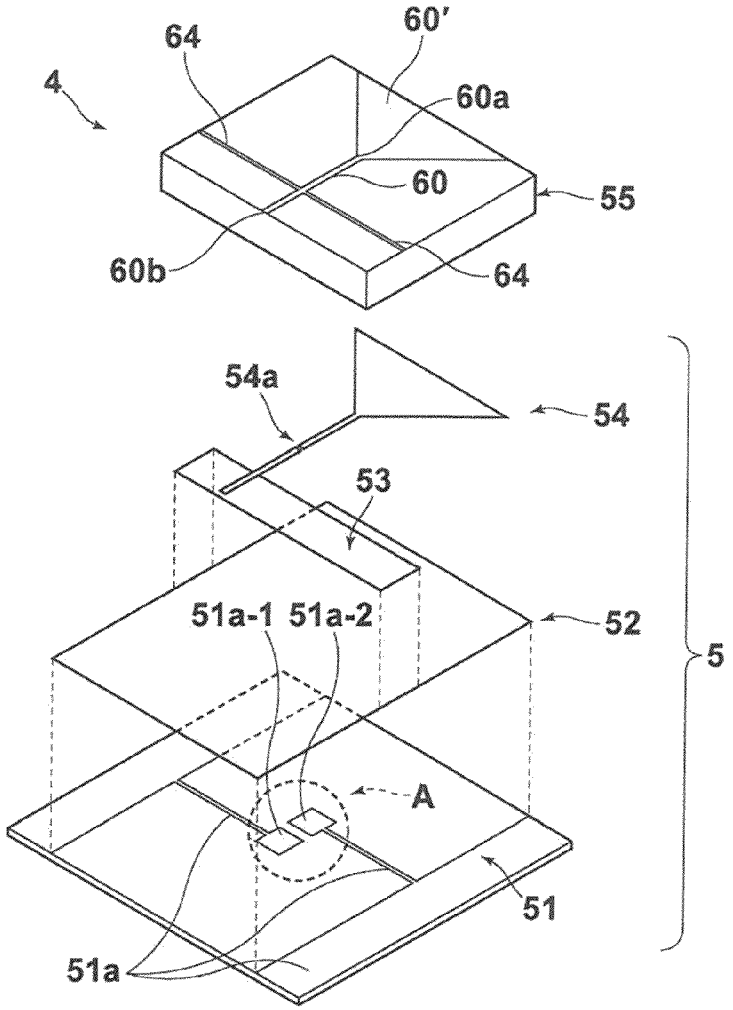
FIG. 5A is an exploded perspective view of a printing device.
Figure 5B:
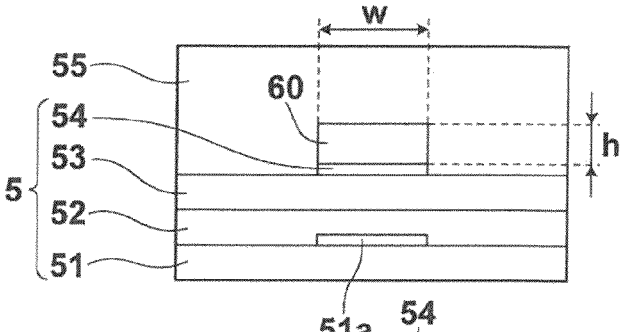
FIG. 5B is a front view of the printing device.
Figure 5C:
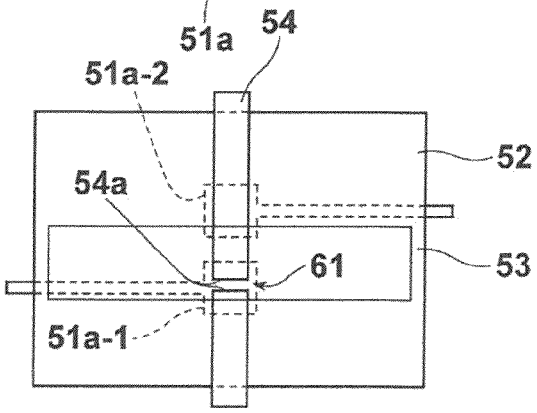
FIG. 5C is a magnified plan view of a main portion A of FIG. 5A.

Meanwhile, in order to utilize the EW phenomenon to printing equipment, a target value for the "amount of liquid movement", which is related to the "appearance of printed images", may be set at 5 pl/0.3 sec to 20 pl/0.3 sec. In addition, a target value for the "liquid movement speed", which corresponds to "printing speed" may be set such that discharge is possible in 0.3 seconds. The liquid movement speed differs depending on the shapes of flow channels. However, the response time until liquid is discharged can be reduced, by shortening the lengths of flow channels. Alternatively, flow speeds can be increased by improving the hydrophilic nature of the flow channels. The present inventor proposes a printing device 4 as a fluid transport device of printing equipment that satisfies the above target performance values. FIG. 5A is an exploded perspective view of the printing device 4, FIG. 5B is a front view of the printing device 4, and FIG. 5C is a magnified plan view of a main portion A of FIG. 5A.

The printing device 4 is formed by sputtering gold (Au) electrodes 51*a* onto a glass substrate 51, as illustrated in FIG. 5A, to provide positive and negative electrodes 51*a*-1 and 51*a*-2 such that they are arranged along the direction that a fluid F flows in, with a narrow gap therebetween.

A 50 μm thick layer of silicone rubber 52, which is a dielectric, is coated on the entire upper surface of the glass substrate 51, on which the Au electrodes 51*a* have been sputtered. Then, a 5 μm layer of CYTOP™ 53 by Asahi glass was coated on the portion above the positive and negative electrodes 51*a*-1 and 51*a*-2, as a hydrophobic dielectric film. Further, a 3 μm layer of aluminum (Al) 54 was sputtered thereon, as a hydrophilic inner wall surface of a flow channel 60. At this time, the aluminum 54 and the positive and negative electrodes 51*a*-1 and 51*a*-2 are partitioned by the silicone rubber 52 and the CYTOP™ 53, and therefore there is no conductive contact between them. The aluminum 54 does not have any electrical functions, because no current flows therethrough.

In addition, a dielectric film is formed by the silicone rubber layer 52 and the CYTOP™ 53 layer. The effect of EW becomes greater if a larger amount of electric charges are induced onto the surface of the dielectric film. Therefore, it is preferable for the dielectric film to be formed by materials having high dielectric constants. At the same time, it is preferable for the dielectric film to be formed by materials having high dielectric strength voltage, such that it is capable of functioning under conditions that a large amount of electric charges are induced thereon, that is, under high voltage.

As illustrated in FIG. 5C, a gap 54*a* having a width of 150 μm in the direction of fluid flow is formed in the aluminum layer 54 at a portion above the positive electrode 51*a*-1. The CYTOP™ layer 53, which is the hydrophobic dielectric film positioned beneath the aluminum layer 54, is exposed at the gap 54*a*. Therefore, the inner wall surface of the flow channel 60 includes the hydrophilic sections, that is, the aluminum layer 54, and the hydrophobic section, that is, the CYTOP™ layer 53. The hydrophobic section functions as a valve portion 61. The above construction is collectively referred to as a glass substrate chip 5.

Next, a PDMS (Poly DiMethyl Siloxane) substrate 55, which is formed by a type of silicone rubber, will be described. As illustrated in FIG. 5A, the PDMS substrate 55 is a hydrophobic sheet having venting channels that function as air vents 64 for introducing air into the flow channel and the valve portion 61 formed as grooves therein. In FIG. 5A, the PDMS substrate 55 is illustrated upside down for the sake of illustrative description. However, as illustrated in FIG. 5B, the surface of the PDMS substrate 55 in which the grooved flow channel 60 is formed is placed in close contact with the glass substrate chip 5, to form the flow channel 60 of the printing device 4.

Note that the width of the venting channels are formed to be smaller than the width of the flow channel 60, to prevent the backflow of fluid. The location at which the groove of the flow channel 60 and the grooves of the venting channels intersect is positioned above the valve portion 61. Note that an ink supply tank 60' having a large capacity is formed such that it communicates with an inlet 60*a* of the flow channel 60. The printing device 4 is constructed as described above.

The fluid containing electrolytes to be transported through the flow channel 60 of the printing device 4 is a 0.1M potassium chloride (KCl) aqueous solution. Inkjet printing paper is employed as the material that absorbs the aqueous solution.

The printing device 4 constructed as described above operates in the same manner as the printhead 2 of the previously described embodiment, by applying voltages and ceasing the application of the voltages to the positive and negative electrodes 51*a*-1 and 51*a*-2.

An experiment was performed, in which the width w of the flow channel 60 was formed to be 25.5 μm, the height h of the flow channel 60 was formed to be 2.7 μm, the length L from the inlet 60*a* to the outlet 60*b* was set to 300 μm, and the aforementioned aqueous solution was caused to flow through the flow channel 60 in a state in which voltages were applied to the positive and negative electrodes 51*a*-1 and 51*a*-2, that is, in a state in which the inner wall surface of the flow channel 60 was hydrophilic. As a result, 21 pl of the aqueous solution was transported by capillary action. The time required for the fluid transport was 0.12 seconds.

Another experiment was performed, in which the inner wall surface of the flow channel 60 was rendered hydrophilic, and 49*n*1 of a liquid to which a water soluble black dye was added, was transferred onto an inkjet printing sheet from the outlet 60*b* by capillary action. As a result, the liquid was able to be transferred onto the inkjet printing sheet as dots having diameters of 950 μm.

Yet another experiment was performed, in which an aqueous solution within the flow channel 60 was sectionalized by the valve portion 61, and then transferred onto a sheet of paper. As a result, the aqueous solution which was sectionalized by the valve portion 61, that is, 6*n*1, which is the volume of the flow channel downstream form the valve portion 61, of the aqueous solution was able to be transferred onto the sheet. The voltage applied at this time was 200V, and the current was of a μA order or less.

These experiments confirmed that the printing device 4 achieves the target performance values, and that the valve portion 61 is capable of completely sectionalizing a predetermined amount of fluid within the flow channel 60, to be discharged through the outlet 60*b*.

Next, a printing device according to another embodiment will be described with reference to FIG. 6. Note that the printing device of the present embodiment is of substantially the same construction as the printhead 2 and the printing device 4 of the previously described embodiments. Therefore, elements which are the same as those described with reference to the previous embodiments are denoted by the same reference numerals, and detailed descriptions thereof will be omitted. Descriptions will be given only with regard to elements which are different from those of the previously described embodiments.

In the printhead 2 and the printing device 4 of the previously described embodiments, the inkjet printing sheet 3 is caused to contact the outlets 10*b* and 60*b* of the flow channels 10 and 60, to transfer the ink i onto the sheet 3. At this time, if the outer peripheral portions of the outlets 10*b* and 60*b* are hydrophilic, the outer peripheral portions become wet with the ink i, and it becomes difficult to transfer accurate amounts of the ink i, which have been sectionalized into predetermined amounts by the valve portions 11 and 61.

Figure 6:
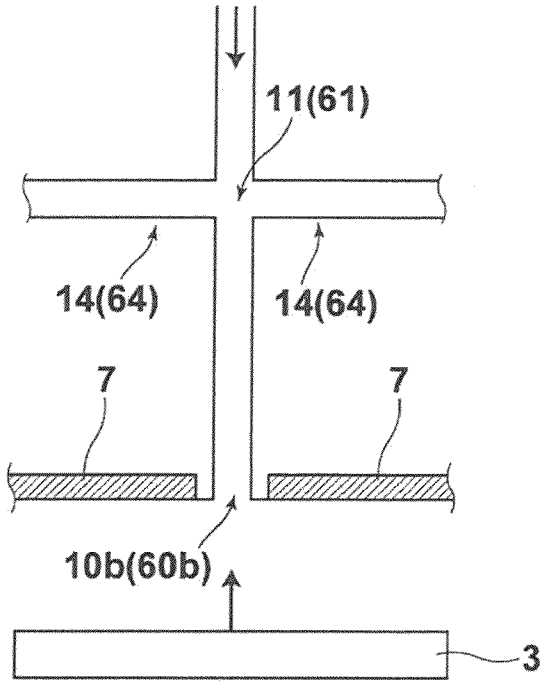
FIG. 6 is a diagram that illustrates a printing device according to another embodiment.

For this reason, in the printing device of the present embodiment, the outer peripheral portion 7 of the outlets 10*b* and 60*b* of the printhead 2 and the printing device 4 that contact the sheet is coated with a hydrophobic dielectric film, as illustrated in FIG. 6. By adopting this configuration, the outer peripheral portion 7 repels the ink i, resulting in substantially no ink i wetting the outer peripheral portion 7. Accordingly, transfer of accurate amounts of the ink i, which have been sectionalized into predetermined amounts by the valve portions 11 and 61, becomes possible.

Figure 7:
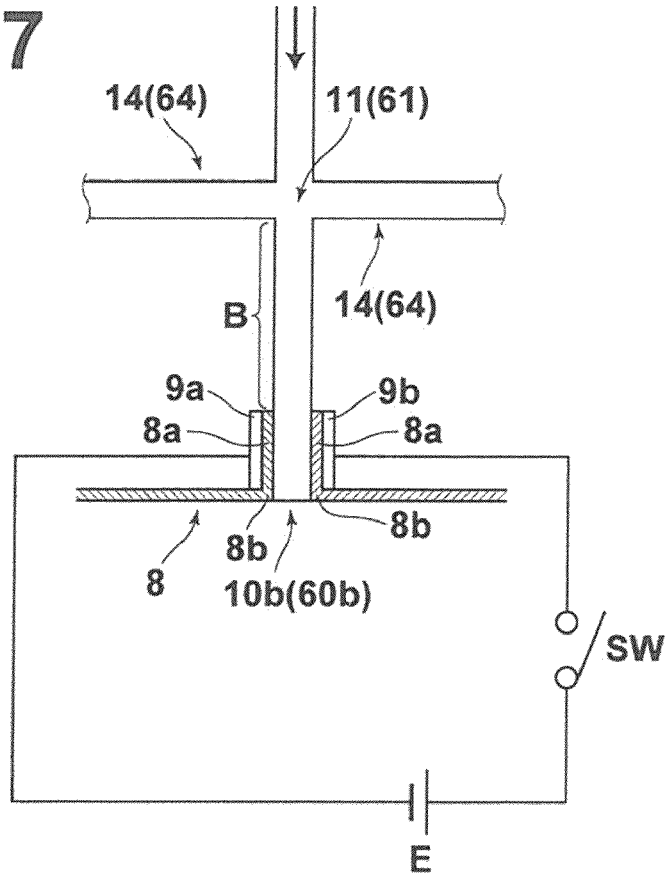
FIG. 7 is a diagram that illustrates a printing device according to still another embodiment.
Figure 8A:
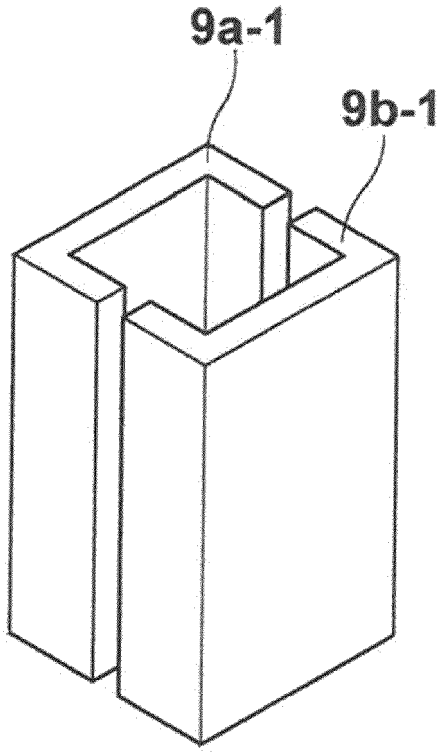
FIG. 8A is a perspective view of an example of second electrodes.
Figure 8B:
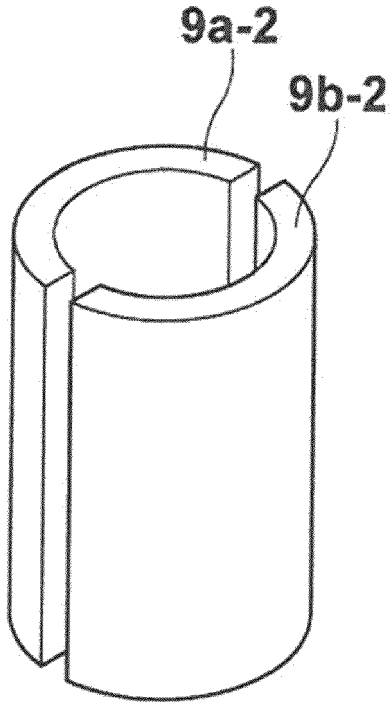
FIG. 8B is a perspective view of another example of second electrodes.

Next, a printing device according to still another embodiment will be described with reference to FIG. 7, FIG. 8A, and FIG. 8B. FIG. 7 illustrates the printing device of the present embodiment, FIG. 8A is a perspective view of an example of second electrodes 9, and FIG. 8B is a perspective view of another example of second electrodes 9. Note that the printing device of the present embodiment is of substantially the same construction as the printhead 2 and the printing device 4 of the previously described embodiments. Therefore, elements which are the same as those described with reference to the previous embodiments are denoted by the same reference numerals, and detailed descriptions thereof will be omitted. Descriptions will be given only with regard to elements which are different from those of the previously described embodiments.

In the printhead 2 and the printing device 4 of the previously described embodiments, the inkjet printing sheet 3 is caused to contact the outlets 10*b* and 60*b* of the flow channels 10 and 60, to transfer the ink i onto the sheet 3. At this time, there are cases in which not all of the ink i, which has been sectionalized into a predetermined amount within the flow channels 10 and 60, is transferred onto the sheet 3 but remains in the vicinities of the outlets 10*b* and 60*b*. The section, at which there is a possibility that the ink i will remain, is referred to as an outlet section. The length of the outlet section varies due to factors such as the viscosity of the ink i, the surface tension of the ink i, the size of the flow channels 10 and 60, the hydrophilic nature of the flow channels 10 and 60, the wettability of the sheet 3, and the like.

For this reason, in the printing device of the present embodiment, inner walls 8*a* of the outlet sections adjacent to the outlets 10*b* and 60*b* of the flow channels 10 and 60 are coated with a hydrophobic dielectric film, except for a hydrophilic section B downstream from the valve portions 11 and 61, as illustrated in FIG. 7. In addition, second electrodes 9*a* and 9*b*, which are separate from the electrodes 13, 51*a*-1 and 51*a*-2 provided at the valve portions 11 and 61, for reducing the surface tension of the ink i, are provided at the inner walls 8*a* of the outlet sections and a peripheral portion 8*b* of an outer peripheral portion 8 adjacent to the outlets 10*b* and 60*b*.

The second electrodes 9*a* and 9*b* may be constructed as a rectangular column which is divided in halves along the flow direction of the ink i, as illustrated in FIG. 8A. One of the divided halves is a positive electrode 9*a*-1, and the other is a negative electrode 9*b*-1. Alternatively, the second electrodes 9*a* and 9*b* may be constructed as a cylindrical column which is divided in halves along the flow direction of the ink i, as illustrated in FIG. 8B. In this case as well, one of the divided halves is a positive electrode 9*a*-2, and the other is a negative electrode 9*b*-2.

In the printing device having the construction described above, voltage is applied to the electrodes 9*a* and 9*b* when the ink i passes through the outlet section illustrated in FIG. 7. Thereby, the inner walls 8*a* of the outlet section and the peripheral portions 8*b*, which are in contact with the electrodes 9*a* and 9*b*, becomes hydrophilic. Then, by causing an absorbent transfer target material such as paper to contact the outlets 10*b* and 60*b*, the ink i, which has been sectionalized into a predetermined amount by the valves 11 and 61, is transferred onto the transfer target material. At this time, in the case that there is ink i remaining within the flow channels 10 and 60 in the vicinities of the outlets 10*b* and 60*b*, the application of voltage is ceased, to change the hydrophilic nature of the inner walls 8*a* and the peripheral portions 8*b* back to a hydrophobic nature.

Thereby, the remaining ink i is transferred onto the transfer target material due to a difference in wettability. Therefore, the ink i, which has been sectionalized into the predetermined amount by the valve portions 11 and 61, can be accurately and completely transferred onto the transfer target material.

Figure 9A:
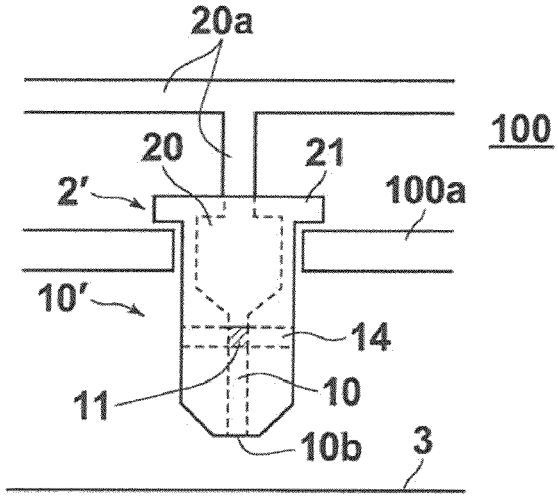
FIG. 9A is a schematic diagram that illustrates a printhead according to a second embodiment.
Figure 9B:
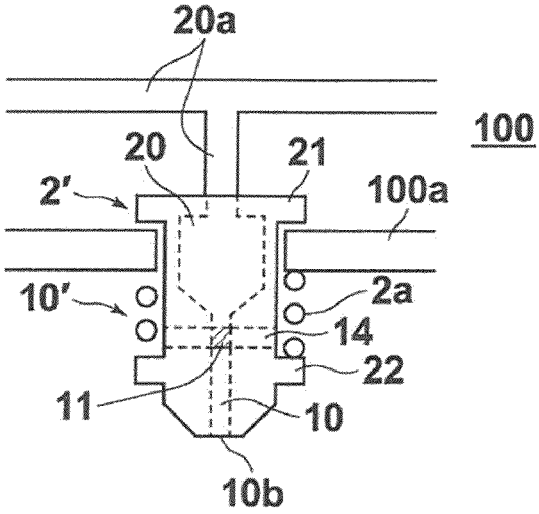
FIG. 9B is a schematic diagram that illustrates a printhead according to a third embodiment.
Figure 9C:
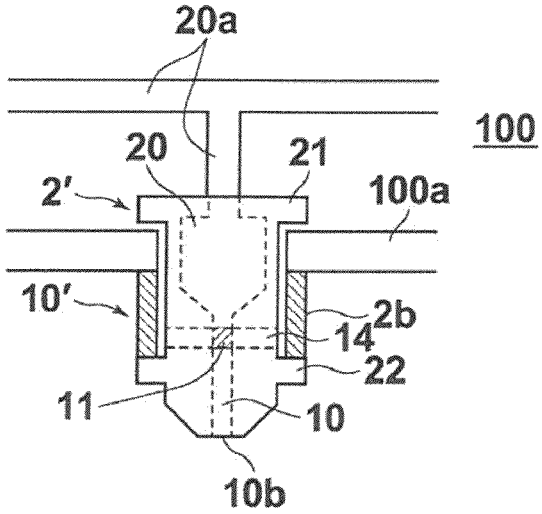
FIG. 9C is a schematic diagram that illustrates a printhead according to a fourth embodiment.

FIG. 9A is a schematic diagram that illustrates a printhead according to a second embodiment. FIG. 9B is a schematic diagram that illustrates a printhead according to a third embodiment. FIG. 9C is a schematic diagram that illustrates a printhead according to a fourth embodiment. Note that the printheads of the second, third, and fourth embodiments are of substantially the same construction as the printhead of the previously described embodiment. Therefore, elements which are the same as those described with reference to the previous embodiments are denoted by the same reference numerals, and detailed descriptions thereof will be omitted. Descriptions will be given only with regard to elements which are different from those of the previously described embodiment.

As illustrated in FIG. 9A, an outlet portion 10', at which the outlet 10 is provided, of the printhead 2' of the second embodiment protrudes from the main body of a printing apparatus 100. Specifically, a flange 21 is provided around an outer peripheral surface of the upper end of the main body of the printhead 2', for example. A configuration may be adopted such that the lower surface of the flange 21 abuts a support plate 100*a*, in which an opening is formed, of the printing apparatus 100, to support the printhead 2'. At this time, an ink supply channel 20*a* that supplies ink i and is provided in the printing apparatus 100 is connected to the ink supply tank 20 within the printhead 2'.

By adopting this configuration, the outlet 10*b* and a sheet 3, to which the ink i is transferred, can be more positively placed in contact, compared to case in which the outlet 10*b* is provided on a flat surface. Note that the outer periphery of the distal end of the outlet portion 10' may be tapered to be of a sharp shape, as illustrated in FIG. 9A, in order to obtain an advantageous effect that the outlet 10*b* digs into the sheet 3.

In addition, the outlet portion 10' may be formed by an elastic member, such as rubber. Here, the outlet portion 10' may be partially formed by the elastic member, for example, only in the proximity of the outlet 10*b*, or may be completely formed by the elastic member, as long as the flow channel 10 itself does not deform. By adopting this configuration, the outlet portion 10' will become flexibly deformable, facilitating contact between the outlet 10*b* and the sheet 3.

In addition, the outlet portion 10' may exhibit elasticity in the direction of the flow of the ink i. Specifically, as illustrated in FIG. 9B, a second flange 22 may be provided about the outer peripheral surface at a lower portion of the printhead 2'. Then, a spring member 2*a* may be provided between the second flange 22 and the lower surface of the support plate 100*a*. In this case, the ink supply channel 20*a* is formed by a pipe or the like, which has elasticity. By adopting this configuration, the outlet portion 10' can be pressed onto the sheet 3, thereby enabling more positive contact between the outlet 10*b* and the sheet 3.

As an example of an alternate configuration, an elastic member 2*b* formed by rubber or the like may be provided instead of the spring member 2*a*, as illustrated in FIG. 9C. In this case, the elastic member 2*b* is formed by a porous material, or ventilating channels are formed therein, such that venting by the air vents 14 is not blocked by the elastic member 2*b*. For example, a gap that communicates with the atmosphere may be provided between the inner surface of the elastic member 2*b* and the openings of the air vents 14, as illustrated in FIG. 9C.

Figure 10:
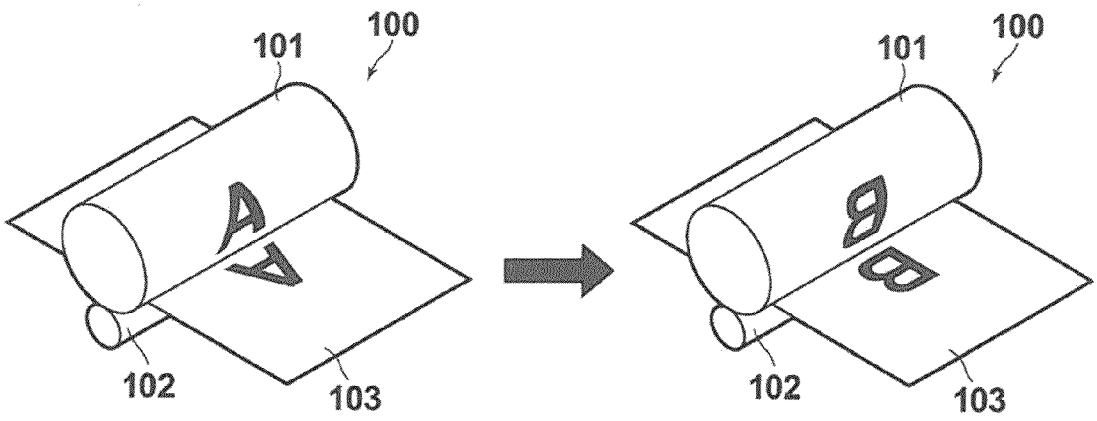
FIG. 10 is a perspective view of the concept of a printing apparatus, in which printheads are mounted.
Figure 11:
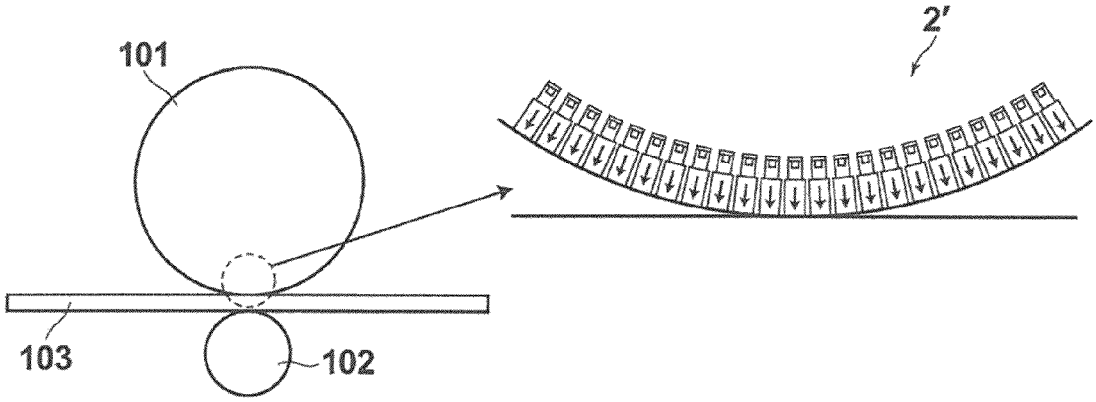
FIG. 11 is a front view of the printing apparatus of FIG. 10.
Figure 12:
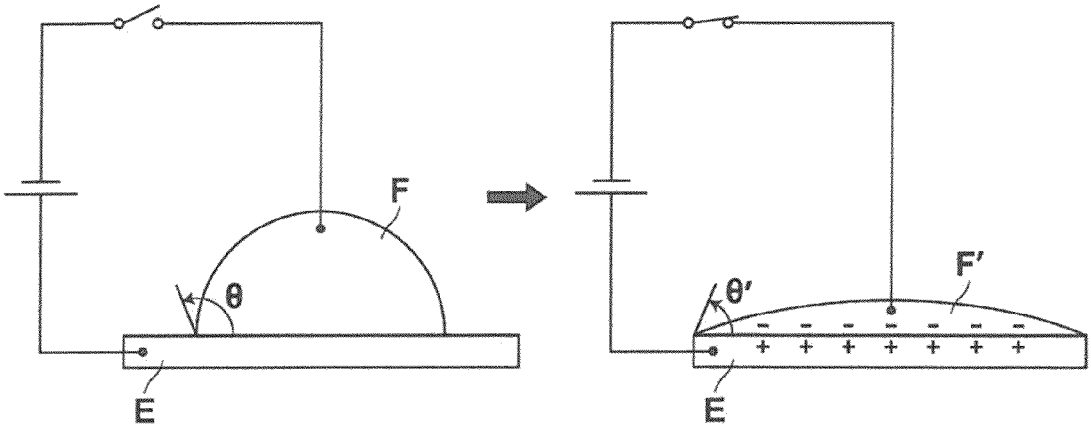
FIG. 12 is a first diagram for explaining the electrowetting phenomenon.
Figure 13:
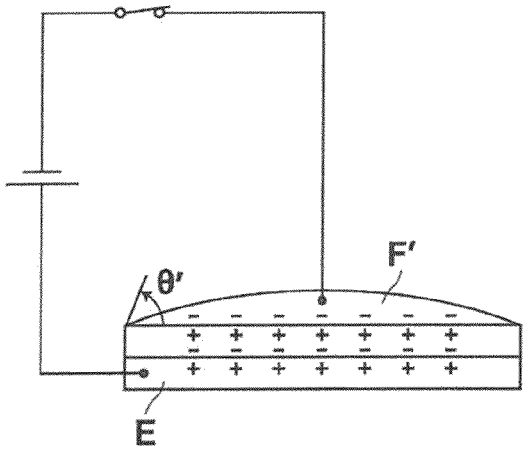
FIG. 13 is a second diagram for explaining the electrowetting phenomenon.

An example a printing apparatus, in which the printheads 2 and 2' of the embodiments described above are mounted, will be described. FIG. 10 is a perspective view of the concept of a printing apparatus, in which the printheads 2 and 2' are mounted. FIG. 11 is a front view of the printing apparatus of FIG. 10.

In the printing apparatus 100 of FIG. 10 and FIG. 11, the outlets of a plurality of the printheads 2 and 2' are provided across the entire surface of a rotatable transfer drum 101. A rotating body 102 that supports a material 103 from beneath the transfer drum 101 causes the printheads 2 and 2' to contact the material 103 for a predetermined amount of time with a relative speed of zero. The outlets of the printheads 2 and 2' rotate at a constant speed while in contact with the material 103, as illustrated in FIG. 11. At this time, voltage is applied and ceased to the electrodes of each of the printheads 2 and 2', to control printed patterns as illustrated in the left half and the right half of FIG. 10.

Note that in the present embodiment, the plurality of printheads 2 and 2' are provided on the transfer drum 101. Alternatively, the printheads 2 and 2' may be provided on a planar transfer body. In this case, the outlets of the printheads 2 and 2' maintain a state of contact with the material 103 for a predetermined amount of time, then removed therefrom. Thereafter, the material 103 is conveyed, and the printing step is repeated if necessary.

In addition, in the present embodiment, the printheads 2 and 2' were provided as a surface. Alternatively, the outlets of a plurality of printheads 2 and 2' may be arranged in a line corresponding to the entire width direction of the material 103, as in a line inkjet printer. In this case, the printheads 2 and 2' and the material 103 move relatively in a direction perpendicular to the direction in which the printheads 2 and 2' are arranged. The entirety of the material 103 is capable of being scanned in a single relative movement operation. Note that scanning may be performed two or more times, to increase the amount of ink transfer.

As a further alternative, the outlets of a plurality of printheads 2 and 2' may be arranged in a line several millimeters to several tens of millimeters in length, as in a serial inkjet printer. In this case as well, the printheads 2 and 2' and the material 103 move relatively in a direction perpendicular to the direction in which the printheads 2 and 2' are arranged. However, only a portion of the material 103 is capable of being scanned in a single relative movement operation. Therefore, after each scanning operation, the printheads 2 and 2' are moved to unscanned positions of the material 103, and a subsequent scanning operation is performed.

Note that in the case that the fluid to be transported in the flow channel is a liquid having functional particles dispersed therein, the fluid transport device of the present invention may be applied to patterning apparatuses that utilize DNA chips, protein chips, cellular chips and the like. Note that by employing aqueous solutions as the liquid, when solvents evaporate after devices, on which patterning with functional materials has been performed, are discarded after use, the burden on the environment can be suppressed compared to cases in which oil based liquids are employed.

Note that all of the embodiments described above employ two electrode systems constituted by positive and negative poles. Alternatively, three electrode systems constituted by a working electrode, an opposing electrode, and a reference electrode may be employed. This is because optimal voltage control can be performed by knowing the electrical potential difference between a positive pole and the fluid, and knowing the electrical potential difference between a negative pole and the fluid. In this case, a working electrode may be the electrode which is provided at the valve portion, an opposing electrode may be the other electrode, and a reference electrode may be provided at a desired position at which the reference electrode contacts the fluid.

The fluid transport device of the present invention and the fluid transport control method that employs the fluid transport device of the present invention are not limited to the embodiments described above. Various changes and modifications are possible, as long as they do not stray from the spirit and scope of the invention.

The invention claimed is:

1. A fluid transport device, for transporting a fluid containing electrolytes within a flow channel, comprising:

at least a portion of the inner walls of the flow channel are hydrophilic from an inlet to an outlet thereof except at at least one valve portion;

the at least one valve portion, is hydrophobic to block transport of the fluid;

electrodes provided at the at least one valve portion to reduce the surface tension of the fluid; and air vents provided at the at least one valve portion to introduce air in order to block the fluid.

2. A fluid transport device as defined in claim 1, wherein:

the electrodes have positive and negative poles; and one of the positive and negative poles are provided at the hydrophobic valve portion.

3. A fluid transport device as defined in claim 2, wherein:

the positive and negative poles are arranged along the flow direction of the fluid.

4. A fluid transport device as defined in claim 1, wherein:

the electrodes and the flow channel are partitioned by dielectric films.

5. A fluid transport device as defined in claim 1, wherein:

the outer peripheral portion of the outlet is hydrophobic.

6. A fluid transport device as defined in claim 1, wherein:

the inner wall of an outlet section of the flow channel and the outer peripheral portion of the outlet are hydrophobic; and second electrodes, for reducing the surface tension of the fluid, are provided at the outlet section and at a peripheral portion adjacent to the outlet.

7. A fluid transport device as defined in claim 1, wherein:

an outlet portion of the flow channel, at which the outlet is located, protrudes outward from a main body of the device.

8. A fluid transport device as defined in claim 7, wherein:

the outlet portion of the flow channel is formed by an elastic member.

9. A fluid transport device as defined in claim 7, wherein:

the outlet portion of the flow channel exhibits elasticity in the direction of fluid flow.

10. A fluid transport device as defined in claim 1, wherein:

the fluid is a liquid having functional particles dispersed therein.

11. A method for controlling fluid transport employing the fluid transport device of claim 1, comprising the steps of:

applying voltages to the electrodes, to change the hydrophobic nature of the valve portion within the flow channel to a hydrophilic nature;

ceasing the application of voltages to change the hydrophilic nature of the valve portion back to a hydrophobic nature; and introducing air into the valve portion via the air vents, to sectionalize predetermined amounts of the fluid.

* * * * *